US008047135B1

(12) United States Patent
Paulic et al.

(10) Patent No.: US 8,047,135 B1
(45) Date of Patent: Nov. 1, 2011

(54) COUNTER-MINE DART

(75) Inventors: Antonio Paulic, Arlington, VA (US); Lance Hamilton Benedict, McLean, VA (US)

(73) Assignee: Lockheed Martin Corporation, Bethesda, MD (US)

( * ) Notice: Subject to any disclaimer, the term of this patent is extended or adjusted under 35 U.S.C. 154(b) by 385 days.

(21) Appl. No.: 12/265,602

(22) Filed: Nov. 5, 2008

Related U.S. Application Data

(60) Provisional application No. 60/985,516, filed on Nov. 5, 2007.

(51) Int. Cl.
*F42C 19/00* (2006.01)

(52) U.S. Cl. ..... 102/216; 102/275; 102/500; 102/272; 89/1.13

(58) Field of Classification Search ..... 102/275, 102/216, 500, 247, 248, 265, 272, 273, 217, 102/489, 499, 266, 396, 397; 86/50; 89/1.13, 89/1.1
See application file for complete search history.

(56) References Cited

U.S. PATENT DOCUMENTS

| | | | | | |
|---|---|---|---|---|---|
| 1,347,716 | A * | 7/1920 | Semple | 102/265 |
| 1,531,717 | A * | 3/1925 | Remondy | 102/265 |
| 2,465,395 | A * | 3/1949 | O'Rear | 102/242 |
| 2,754,760 | A * | 7/1956 | Wynn | 102/209 |
| 2,806,428 | A * | 9/1957 | Weiss | 102/265 |
| 2,948,220 | A * | 8/1960 | Bennett | 102/257 |
| 3,633,510 | A * | 1/1972 | Bernardin | 102/254 |
| 3,808,972 | A * | 5/1974 | Cammack et al. | 102/394 |
| 3,968,748 | A * | 7/1976 | Burford et al. | 102/394 |
| 4,690,057 | A * | 9/1987 | Carlsson | 102/266 |
| 5,591,935 | A * | 1/1997 | Shamblen et al. | 102/500 |
| 5,612,505 | A * | 3/1997 | O'Brasky et al. | 102/268 |
| 5,872,324 | A * | 2/1999 | Watson et al. | 102/265 |
| 6,540,175 | B1 * | 4/2003 | Mayersak et al. | 244/3.15 |
| 7,343,860 | B2 * | 3/2008 | Michel et al. | 102/275 |
| 7,856,928 | B1 * | 12/2010 | Paulic | 102/402 |
| 2003/0140811 | A1 * | 7/2003 | Bone | 102/266 |
| 2008/0011179 | A1 * | 1/2008 | Michel et al. | 102/275 |
| 2010/0307326 | A1 * | 12/2010 | Paulic | 89/1.13 |

* cited by examiner

*Primary Examiner* — Michael Carone
*Assistant Examiner* — Jonathan C Weber
(74) *Attorney, Agent, or Firm* — DeMont & Breyer, LLC

(57) ABSTRACT

Some embodiments of the invention provide a dart that contains an HE payload, two time-delay fuses, one providing a relatively longer delay and the other providing a relatively shorter delay and two triggering mechanisms for triggering the fuses. The first triggering mechanism, which triggers on contact with a mine lid, triggers the relatively shorter time-delay fuse. The second mechanism, which triggers on overburdening exposure to water, sand, or soil, triggers the relatively longer time-delay fuse.

11 Claims, 6 Drawing Sheets

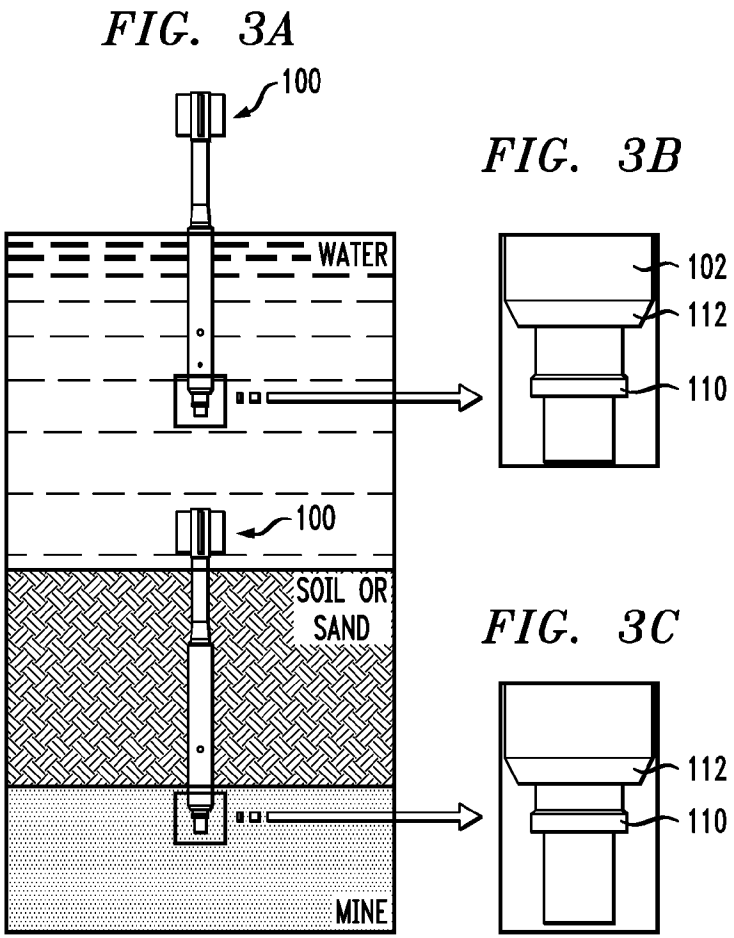
FIG. 3A
100
WATER
100
SOIL OR SAND
MINE
FIG. 3B
102
112
110
FIG. 3C
112
110
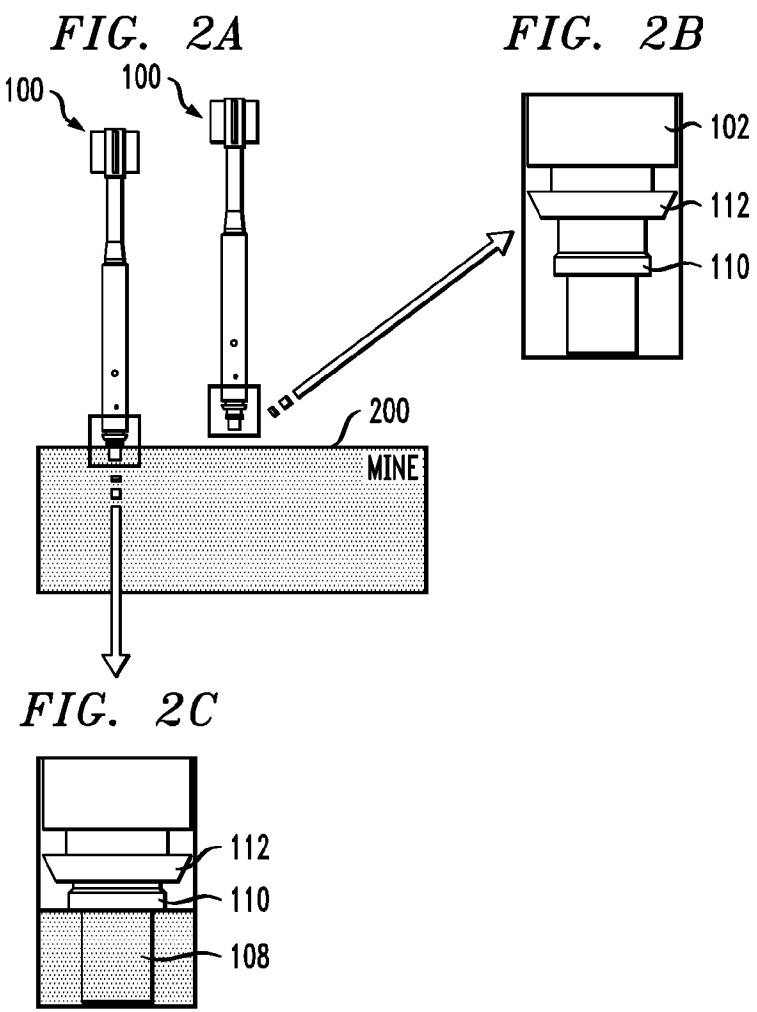
FIG. 2A
100
100
200
MINE
FIG. 2B
102
112
110
FIG. 2C
112
110
108

COUNTER-MINE DART

STATEMENT OF RELATED CASES

This case claims priority of U.S. Provisional Patent Application Ser. No. 60/985,516 filed on Nov. 5, 2007 and incorporated by reference herein.

FIELD OF THE INVENTION

The present invention relates generally to munitions.

BACKGROUND OF THE INVENTION

In anticipation of an amphibious military attack along a particular stretch of beach, defenders might deploy anti landcraft mines and anti-tank mines along the beach zone. The assault force will typically seek to defeat the mines via a counter-mine system before landing on the beach.

According to one proposed counter-mine system, hundreds of thousands of small caliber (e.g., 50 caliber, etc.) "darts" that contain high explosive ("HE") material are rained-down upon the mine-laden beach zone. The darts are delivered via missile(s) from military aircraft. In one design, upon impact with a mine casing or lid, a brief delay timer within the dart is initiated. The delay provides time (e.g., 500 microseconds, etc.) for the dart to penetrate the lid and reach the mine's explosive (e.g., TNT, etc.) payload. After this brief delay and with the dart's HE material within the mine's payload, the dart's HE material is detonated, thereby neutralizing the mine.

If a dart does not impact a mine, its timer will not be initiated. If this occurs, the dart will simply come to rest, unexploded, a few feet into the sand or soil of the beach zone. As a function of the mine-field density, tens of thousands or hundreds of thousands of unexploded darts might litter the beach zone.

Unexploded darts pose an extreme risk to civilians, in particular children. A curious child tampering with an unexploded dart might inadvertently trigger its HE payload with dire consequences. Furthermore, HE material recovered from unexploded darts by enemy combatants could be used to create improvised explosive devices that could be used, in turn, against the assault force.

SUMMARY OF THE INVENTION

The present invention provides a way to ensure that an explosive projectile detonates regardless of whether or not it contacts its target.

The illustrative embodiment of the invention is a "dart" (small projectile) that contains an HE payload, two time-delay fuses, one providing a relatively longer delay (e.g., one second, etc.) and the other providing a relatively shorter delay (e.g., 500 microseconds, etc.), and a first and a second triggering mechanism for triggering the fuses. The first triggering mechanism, which triggers on contact with a mine lid, triggers the relatively shorter time-delay fuse. The second mechanism, which triggers upon an overburdening exposure to water, sand, or soil, triggers the relatively longer time-delay fuse.

Consider mines that have been deployed in a beach zone. These mines will typically be located just off the beach in shallow water or on the beach buried in the sand. A dart on its way to these mines will first encounter water, sand or soil, which will trigger the second triggering mechanism and initiate the relatively longer delay train.

Assuming that the dart does impact a mine, the first triggering mechanism will trigger on the impact with the mine's lid and initiate the shorter delay train. In most such instances, the predetermined delay provided by the longer delay train will not have a chance to expire. Rather, the shorter delay initiated on contact with the mine line will expire first. Of course, in either case, the dart will detonate, thereby neutralizing the mine.

But consider what happens if the dart does not impact a mine. As previously mentioned, the longer delay train will have been initiated since the dart will necessarily experience an overburdening encounter with water, sand, or soil. As a consequence, even if the dart does not impact a mine lid, it will nevertheless explode. In this fashion, the second triggering mechanism serves as a "fail-safe" measure to ensure that all darts that are deployed will explode, regardless of whether or not they impact a mine.

BRIEF DESCRIPTION OF THE DRAWINGS

FIG. 2A depicts the projectile of FIG. 1A approaching and impacting on a mine.

FIG. 2B depicts the "lip" of the mine trigger and the "lip" of UXO trigger before contact with the mine or overburden.

FIG. 2C depicts the triggers after contact with the lid of the mine.

FIG. 3A depicts the projectile of FIG. 1A passing through water and sand or soil on approach to a mine, and also impacting the mine.

FIG. 3B depicts the "lip" of mine trigger and the "lip" of UXO trigger after overburdening exposure to water or sand but prior to impact with the lid of a mine.

FIG. 3C depicts the triggers after contact with the lid of the mine.

DETAILED DESCRIPTION

Figure 1A:
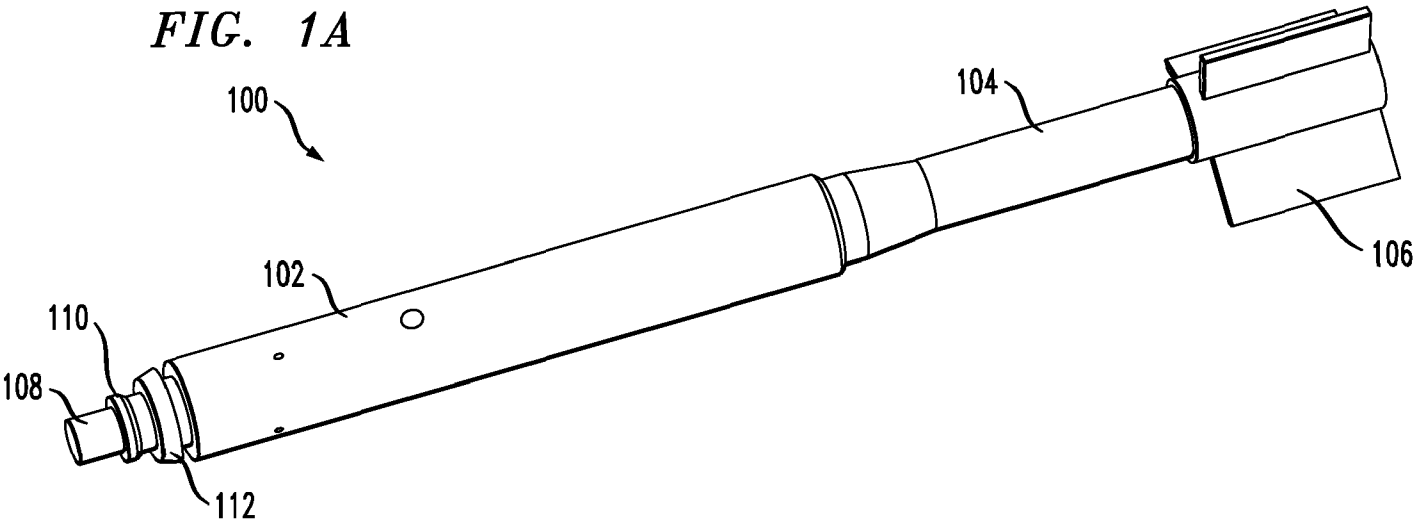
FIG. 1A depicts, via a side perspective view, projectile 100 in accordance with the illustrative embodiment of the present invention.
Figure 1B:
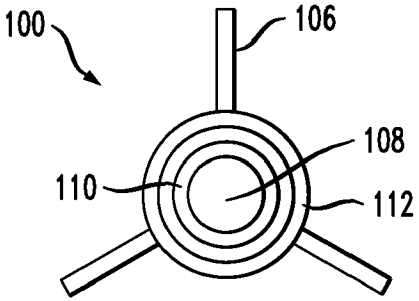
FIG. 1B depicts a front view of the projectile of FIG. 1A.

FIGS. 1A and 1B depict respective perspective and front views of projectile 100 in accordance with the illustrative embodiment of the present invention. As depicted in those figures, projectile 100 includes outer nose 102, tail 104, fins 106, standoff pin 108, mine trigger 110, and unexploded ordnance ("UXO") trigger 112.

Outer nose 102 contains most of standoff pin 108, triggers 110 and 112. The outer nose also contains other elements that are involved in the detonation of the projectile's explosive payload. These other elements are described later in this specification in conjunction with FIGS. 8, 9, 10A and 10B.

Tail 104 is aft of outer nose 102. The tail contains the bulk of the explosive payload of projectile 100. In accordance with the illustrative embodiment, the explosive payload is a high explosive, such as PBXN-5. Other high-explosive materials may suitably be used. In some embodiments for use in other applications, conventional explosives (i.e., as opposed to high-explosives) can be used as the payload.

Fins 106 depend from the tail 104. The fins stabilize the projectile as it moves (i.e., falls) through water or air.

A portion of standoff pin 108 extends forward of outer nose 102. In some embodiments, the standoff pin has a blunt nose to aid in creating supercavitating movement through water, which improves water penetration distance and trajectory accuracy. Standoff pin 108 also functions as a support for cylindrical, sleeve-like triggers 110 and 112.

Furthermore, since it creates the cavity through which projectile 100 runs, standoff pin 108 plays a role in "shielding" mine trigger 110 from water and sand impingement. Note that at sufficient speeds, as the projectile moves through sand, standoff pin 108 creates a terradynamic cavity, such that neither the triggers nor the surface of projectile 100 (other than the blunt nose of the projectile) actually contact the sand.

The only external portion of mine trigger 110 is a "lip," which contacts the mine lid on impact. Mine trigger 110 triggers a briefly delayed detonation of the projectile's high-explosive payload when the trigger impacts a mine lid. The reason for the brief time delay is to allow the projectile time to penetrate the mine's lid and enter its explosive payload. Detonation of the high-explosive payload of the projectile when in the presence of the mine's payload will neutralize the mine.

UXO trigger 112 triggers a briefly delayed detonation of the projectile's high-explosive payload when the trigger experiences "overburdening" exposure to water, sand, or soil overburden. As used herein, the term "overburdening" means exposure or contact that actuates (i.e., triggers) a trigger (e.g., UXO trigger 112, etc.) by imparting a force to the trigger that is in excess of the trigger's actuation threshold. The time delay initiated by UXO trigger 112 is somewhat longer than the time delay initiated by mine trigger 110. The only external portion of UXO trigger 112 is a "lip," somewhat larger than the lip of the mine trigger.

In the illustrative embodiment, UXO trigger 112 and mine trigger 110 are co-axially arranged with respect to one another, with the smaller diameter mine trigger being disposed radially inward of the UXO trigger.

FIG. 2A depicts a sequence wherein projectile 100 descends toward and contacts mine 200. FIG. 2B depicts the state of mine trigger 110 and UXO trigger 112 prior to impact with the lid of mine 200. As depicted in FIG. 2B, mine trigger 110 and UXO trigger 112 are in un-triggered positions, wherein the mine trigger is spaced from the UXO trigger and the UXO trigger is spaced apart from outer nose 102. FIG. 2C depicts the state of mine trigger 110 and UXO trigger 112 after impact with the lid of mine 200. As depicted in FIG. 2C, standoff pin 108 penetrates the mine lid and, on contact with the lid, mine trigger 110 is forced aft. UXO trigger 112 remains in its un-triggered position. As described further later in this specification, the movement aft of the mine trigger 110 initiates a relatively shorter time-delay fuse.

FIG. 3A depicts a sequence wherein projectile 100 descends through water 300 and sand/soil 302 to contact mine 200. FIG. 3B depicts the state of mine trigger 110 and UXO trigger 112 after overburdening exposure to water but prior to impact with the lid of mine 200. As depicted in FIG. 3B, overburdening exposure to water has forced UXO trigger 112 to move aft, abutting outer nose 102. As described further later in this specification, this movement of the UXO trigger 112 initiates a relatively longer time-delay fuse. Mine trigger 110, however, will not trigger on exposure to water (i.e., the mine trigger cannot be "overburdened" by exposure to water) and therefore remains in its un-triggered state.

Figure 4A:
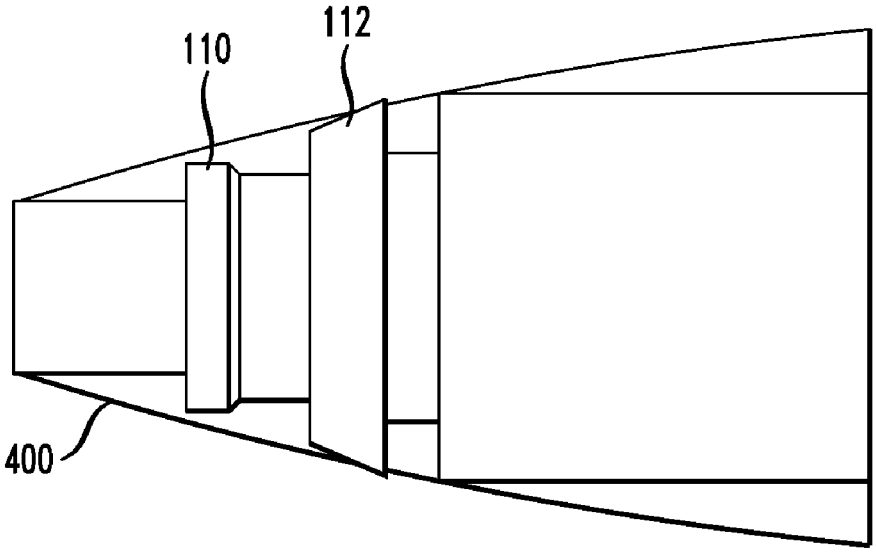
FIG. 4A depicts the projectile moving through water in a supercavitating mode, and depicts a portion of the lip of the UXO trigger extending into a region of high drag forces (i.e., water) that exists beyond a bubble of air that forms around the projectile.
Figure 4B:
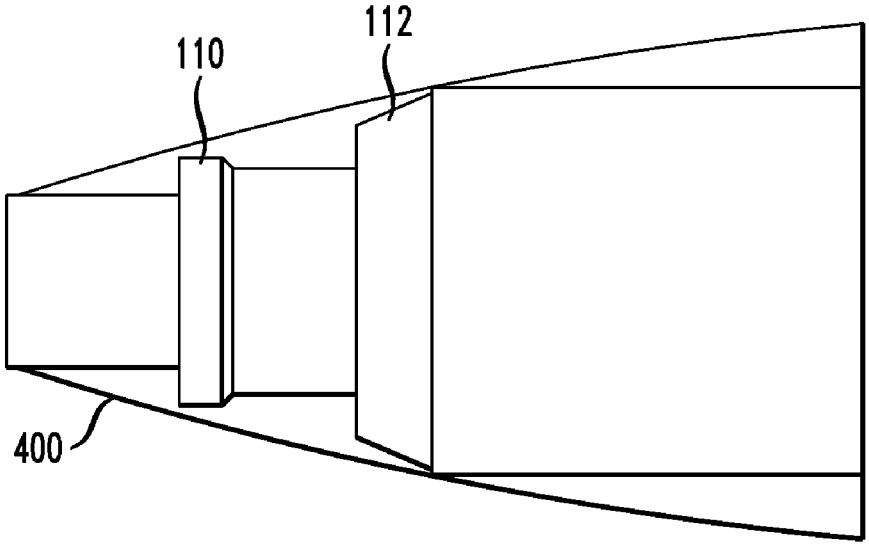
FIG. 4B depicts the projectile of FIG. 4A after the UXO trigger has triggered due to overburdening exposure in the high drag region.

FIGS. 4A and 4B depict the manner in which UXO trigger 112 is triggered by overburdening exposure to water. FIG. 4A depicts projectile 400 moving in a supercavitating mode through water. Supercavitation arises when, by virtue of its speed and certain structural attributes, a body, such as projectile 100, moving through water creates a large "bubble" of water vapor that surrounds the body. Compared to the drag that would normally be experienced moving through pure water, the drag within the 'bubble" is greatly reduced.

As depicted in FIG. 4A, a portion of UXO trigger 112 extends beyond the low-drag region. It therefore experiences high drag, which overburdens the UXO trigger and causes it to trigger, as depicted in FIG. 4B. Once triggered, the UXO trigger moves completely within the supercavitation bubble, which is advantageous for maintaining the projectile's velocity and stability.

FIG. 3C depicts the state of mine trigger 110 and UXO trigger 112 after penetrating mine 200. As depicted in FIG. 3C, mine trigger 110 is forced aft. In other words, both triggers have been triggered. As discussed in conjunction with FIG. 2C, movement of mine trigger 110 initiates the relatively shorter time-delay fuse.

In some embodiments, the time delay provided by the relatively longer time-delay fuse is about one second and the time delay provided by the relatively shorter time-delay fuse is about 500 microseconds. At the speed that projectile 100 is typically moving, and given a likely distance of a few feet between the triggering of UXO trigger 112 and the triggering of mine trigger 110, the shorter time-delay will likely expire first. Of course, one or the other of the time delay fuses will ultimately detonate projectile 100 and, presumably, mine 200.

Figure 5:
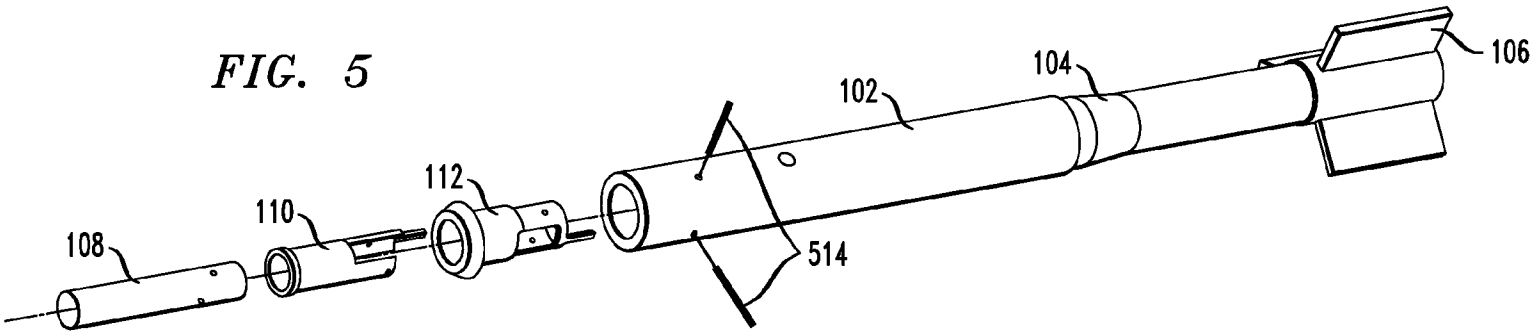
FIG. 5 depicts an exploded view of the nose of projectile of FIG. 1A.

FIG. 5 depicts an exploded view of some of the elements of projectile 100. In particular, FIG. 5 depicts standoff pin 108, mine trigger 110, UXO trigger 112, and shear pins 514. Portions of the standoff pin 108 and both triggers that are normally within outer nose 102 are shown in FIG. 5.

Figure 6B:
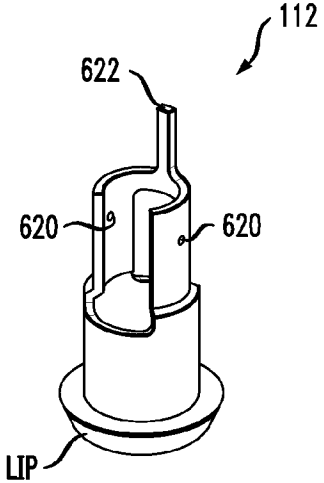
FIG. 6B depicts an embodiment of the UXO trigger.
Figure 6A:
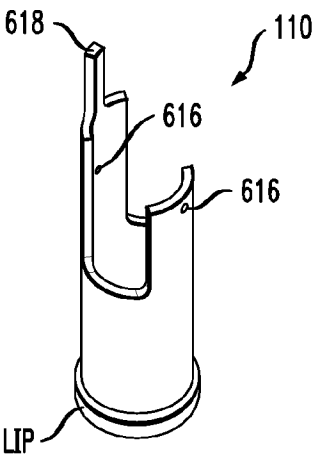
FIG. 6A depicts an embodiment of the mine trigger.

FIG. 6A depicts further detail of mine trigger 110. As depicted in FIG. 6A, the mine trigger has a sleeve-like form. The external lip depends from one end of the sleeve and firing pin 618 depends from the other end. As previously noted, in the illustrative embodiment, the lip is substantially the only portion of mine trigger 110 that is normally visible and remains outside and forward of nose 102.

FIG. 6B depicts further detail of UXO trigger 112. As depicted in FIG. 6B, the UXO trigger has a sleeve-like form. The external lip depends from one end of the sleeve and firing pin 622 depends from the other end. As previously mentioned, in the illustrative embodiment, the lip is substantially the only portion of UXO trigger 112 that is normally visible and remains outside and forward of nose 102.

Figure 7:
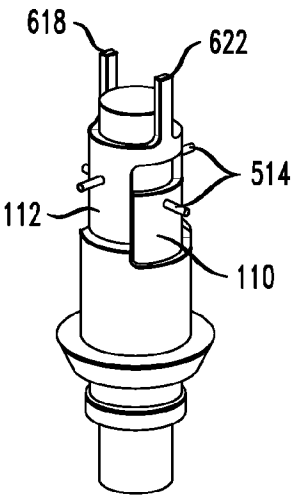
FIG. 7 depicts the two triggers coupled together.

Both the UXO trigger 112 and the mine trigger 110 have "cut-out" regions that are proximal to respective firing pins 622 and 618. These openings enable the two triggers to operate independently of one another while being substantially nested, as depicted in FIG. 7. More particularly, these cut-out regions permit shear pins 514 to couple each trigger to outer nose 102 and permit independent functioning of the triggers.

Shear pins 514 prevent mine trigger 110 and UXO trigger 112 from moving until triggered. When sufficient (i.e., "overburdening") force is applied to the "lips" of these triggers, such as caused by high velocity impact with a mine lid (mine trigger 110) or the high drag forces generated by rapid movement through water (UXO trigger 112), shear pins 514 are sheared. In some embodiments, the shear pins used for both triggers are the same. In such embodiments, the difference in response of the triggers (i.e., the amount of force that will cause a trigger to trigger) can be effected by differences in the frontal surface area of the triggers, differences in the diameter of the triggers, etc. Alternatively, or in conjunction with differences in the lips of the triggers, the shear pins for the two triggers can have different diameters or be made from different materials of construction.

Figure 8:
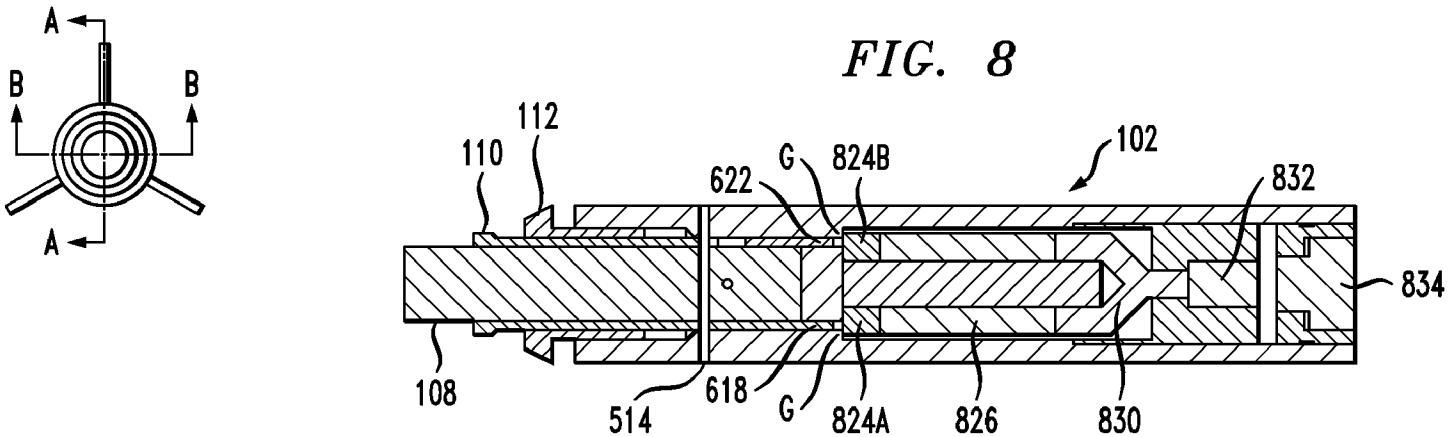
FIG. 8 depicts a cross-sectional view through the line B-B of the nose portion of the projectile of FIG. 1A.

FIG. 8 depicts a cross-sectional view of nose 102 of projectile 100 along the line B-B, in the direction indicated. As depicted in FIG. 8, firing pin 618 of mine trigger 110 and firing pin 622 of UXO trigger 112 extend aft toward respective stab detonators 824A and 824B. In a pre-triggered state such as depicted in FIG. 8, wherein both shear pins 514 are undisturbed, there is a small gap G between the firing pins and the stab detonators.

Relatively shorter time-delay fuse 826 is disposed aft of stab detonator 824A and relatively longer time-delay fuse 828 is disposed aft of stab detonator 824B. Both fuses 826 and 828 are operatively coupled to detonating cord 830, which, in turn, is operatively coupled to booster 832. The booster comprises a small amount of high explosive, such as PBXN-5. Explosive payload 834 is aft of booster 832. Most of payload 834 is disposed in tail 104.

Figure 9:
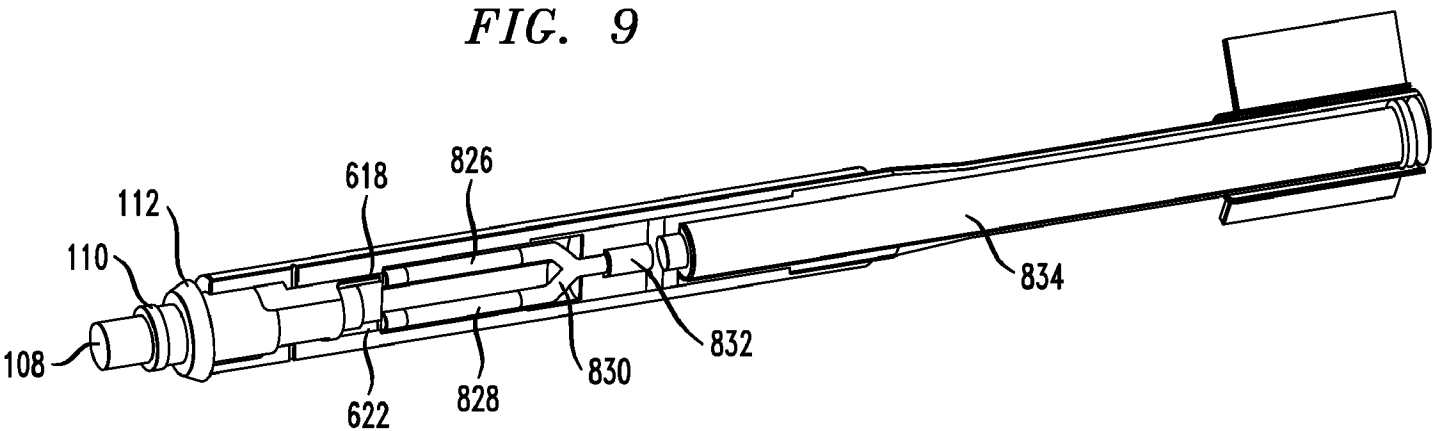
FIG. 9 depicts a partial cutaway, perspective view of the projectile of FIG. 1A.

FIG. 9 depicts a cut-away, perspective view of projectile 100 along the line A-A, in the direction indicated. FIG. 9 depicts standoff pin 108, mine trigger 110, UXO trigger 112, firing pins 618 and 622, time-delay fuses 826 and 828, detonating cord 830, booster 832, and explosive payload 834.

Figure 10A:
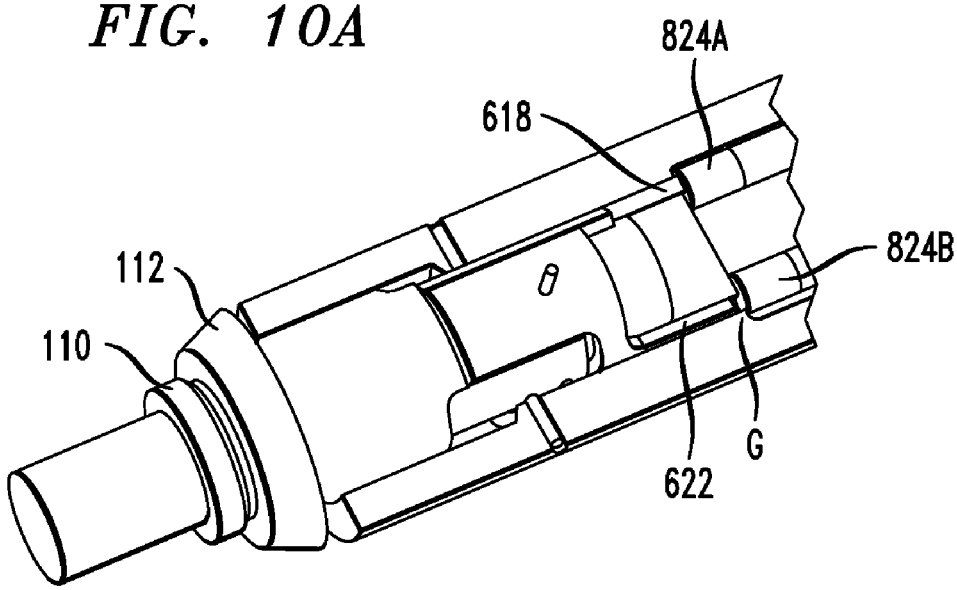
FIG. 10A depicts a partial cutaway, perspective view of the nose of the projectile, wherein the mine trigger has been triggered.
Figure 10B:
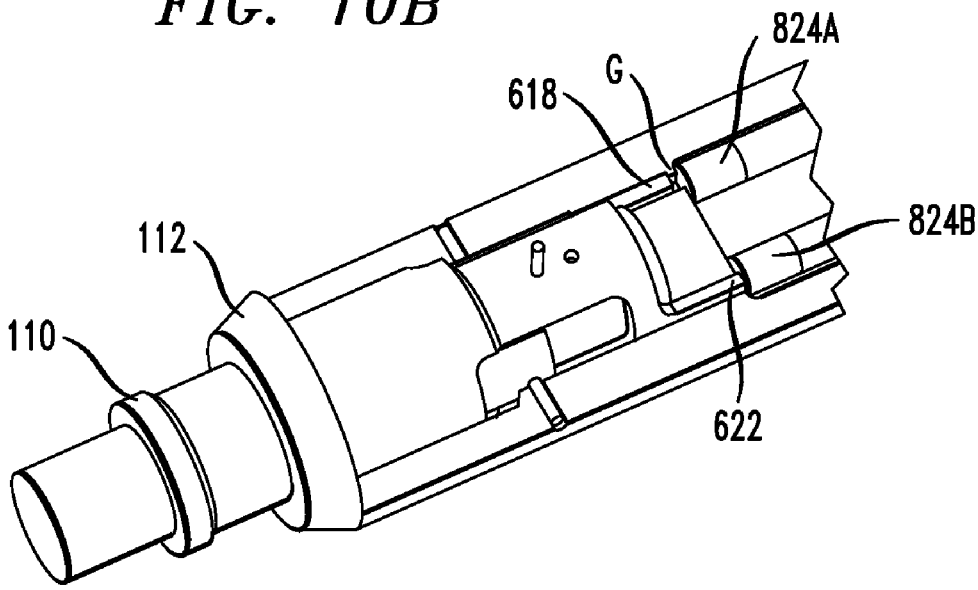
FIG. 10B depicts a partial cutaway, perspective view of the nose of the projectile, wherein the UXO trigger has been triggered.

FIGS. 10A and 10B depict the triggering of respective time-delay fuses 824A and 824B. As depicted in FIG. 10A, mine trigger 110 has been triggered (the cooperating shear pin has been sheared) and has moved aft. This forces firing pin 618 into stab detonator 824A, initiating the shorter time-delay energetic train. It is notable that UXO trigger 112 was not triggered. As a consequence, gap G remains between firing pin 622 and stab detonator 824B.

FIG. 10B depicts the triggering of UXO trigger 112. When the cooperating shear pin shears due to overburdening exposure, the UXO trigger moves aft, forcing firing pin 622 into stab detonator 824B. This initiates the longer time-delay energetic train. Since mine trigger 110 was not triggered, gap G remains between firing pin 618 and stab detonator 824A.

In the illustrative embodiment, two separate triggers 110 and 112 were used to trigger the relatively shorter or relatively longer time delays. In some alternative embodiments, a single trigger that is physically adapted to trigger either or both fuses is used.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. A projectile comprising:

a high-explosive payload;

a first triggering device, wherein the first triggering device is triggered by contact with a mine;

a first time-delay fuse that provides a relatively shorter time delay, wherein expiration of the relatively shorter time delay results in detonation of the high-explosive payload, and wherein the first time-delay fuse is initiated when the first triggering device is triggered, and;

a second triggering device, wherein the second triggering device is triggered by overburdening exposure to water, sand, or soil; and a second time-delay fuse that provides a relatively longer time delay, wherein expiration of the relatively longer time delay results in detonation of the high-explosive payload, and wherein the second time-delay fuse is initiated when the second triggering device is triggered;

wherein the first triggering device and the second triggering device are co-axial sleeves that are independently movable in an axial direction.

2. The projectile of claim 1 wherein the first triggering device and the second triggering device are proximal to a nose of the projectile.

3. The projectile of claim 1 wherein the first triggering device and the second triggering device are co-axial with respect to one another.

4. The projectile of claim 1 wherein the first triggering device and the second triggering device move aft when triggered, respectively.

5. The projectile of claim 1 further comprising a first stab detonator that initiates the first time-delay fuse, and wherein the first triggering device comprises a first firing pin, and wherein the first triggering device, the first firing pin, and the first stab detonator are arranged so that when the first triggering device is triggered, the first firing pin moves into contact with the first stab detonator, thereby initiating the first time-delay fuse.

6. The projectile of claim 1 wherein the relatively shorter time delay is about 500 microseconds or less.

7. The projectile of claim 1 wherein the relatively longer time delay is about 1 second.

8. The projectile of claim 1 wherein the projectile is 0.44 caliber.

9. A projectile comprising:

a high-explosive payload;

a first triggering device, wherein the first triggering device is triggered by contact with a mine;

a first time-delay fuse that provides a relatively shorter time delay, wherein expiration of the relatively shorter time delay results in detonation of the high-explosive payload, and wherein the first time-delay fuse is initiated when the first triggering device is triggered, and;

a second triggering device, wherein the second triggering device is triggered by overburdening exposure to water, sand, or soil; and a second time-delay fuse that provides a relatively longer time delay, wherein expiration of the relatively longer time delay results in detonation of the high-explosive payload, and wherein the second time-delay fuse is initiated when the second triggering device is triggered;

wherein the projectile is configured for supercavitating movement through water, and wherein the second triggering device is dimensioned and arranged such that, before triggering, the second triggering device extends beyond a low drag region, which is created around the projectile during supercavitating movement, and into a high drag region.

10. The projectile of claim 9 wherein the second triggering device triggers when exposed to overburdening drag forces in the high drag region.

11. The projectile of claim 10 wherein the second triggering device is dimensioned and arranged so that after it is triggered, it remains substantially within the low drag region.

* * * * *